United States Patent [19]

Pichard

[11] 4,005,660

[45] Feb. 1, 1977

[54] PROJECTILES FOR AIR ARMS

[76] Inventor: Joseph Francis Louis John Pichard, 14, Allard St., Hull, Quebec, Canada, J8X 1H2

[22] Filed: Apr. 2, 1976

[21] Appl. No.: 672,978

Related U.S. Application Data

[63] Continuation of Ser. No. 560,399, March 20, 1975, abandoned.

[52] U.S. Cl. ..... 102/92.1; 273/106 E

[51] Int. Cl.[2] ..... F42B 11/02

[58] Field of Search ..... 102/92.1, 92.2, 92.3, 102/92.4, 92.6, 92.5, 41; 273/106 R, 106 E

[56] References Cited

UNITED STATES PATENTS

| | | | |
|---|---|---|---|
| 3,450,050 | 6/1969 | Robinson | 102/92.4 |

FOREIGN PATENTS OR APPLICATIONS

| | | | |
|---|---|---|---|
| 463,491 | 5/1951 | Italy | 273/106 E |
| 264,944 | 11/1949 | Switzerland | 102/923 |
| 308,943 | 4/1929 | United Kingdom | 102/92.1 |
| 777,324 | 6/1957 | United Kingdom | 102/92.1 |

*Primary Examiner*—Verlin R. Pendegrass
*Attorney, Agent, or Firm*—Gardiner, Sixbey, Bradford & Carlson

[57] ABSTRACT

An improved pellet form for achieving relatively high muzzle velocity when discharged from the barrel of a gas rifle, particularly a high-performance air rifle, has a pellet head portion of any suitable profile and diameter providing a free-sliding but close fit for the nominal barrel bore, e.g. the 0.177 and 0.22 standard bores, and has a conventional rearwardly-flaring skirt of conical shell form; improved early gas sealing and improved swaging of the skirt margin is induced by novel bevelling of the inner surface of the skirt margin, the trailing edge being tapered to a thin annulus, while the outer surface of the skirt has a terminal portion formed with conical apex angle greater than the apical angle pertaining to the major length portion of the skirt forward of the trailing edge. The skirt edge is initially an interference fit for a diameter comparable to the diameter across opposed rifling grooves, and is a light force fit into the nominal barrel bore diameter. Intimate molding of the skirt margin achieves rapid early sealing, preventing blow-by of gas, while drag is relatively low due to the restricted area of metal which is gas-pressed against the barrel wall. Tests verify significantly flatter trajectories and higher penetration energies for pellets according to the invention.

10 Claims, 6 Drawing Figures est penetration will have a head which is approximately paraboloidal, or a portion of a prolate or oblate spheroid; for target shooting a flat punch face will be preferred; for longest range, i.e. lowest decrement of velocity for unit distance of travel expressed as a percentage, known elongate head forms including cylindrical surfaces spaced axially by annular recesses may be chosen. A conical head form when combined with the improved skirt margin and plural head lands has been observed to be consistently of low velocity decrement and to fly accurately. Regardless of the profile chosen for the head, pellets incorporating the improved low-friction sealing terminal edge configuration of the present invention provide the advantages of reduced friction drag in the barrel, higher peak bore pressure, and higher muzzle velocities as compared with prior art diabolo pellet forms of identical grain weights and head dimensions. In actual tests, the increased muzzle velocity was found to be more nearly constant than velocities of conventional pellets and the accurace of flight for usual target distances, e.g. 10 meters and greater, was superior.

The invention may be more fully comprehended by studying the following description of its embodiments, in conjunction with the figures of the accompanying drawing, wherein.

Figure 1:
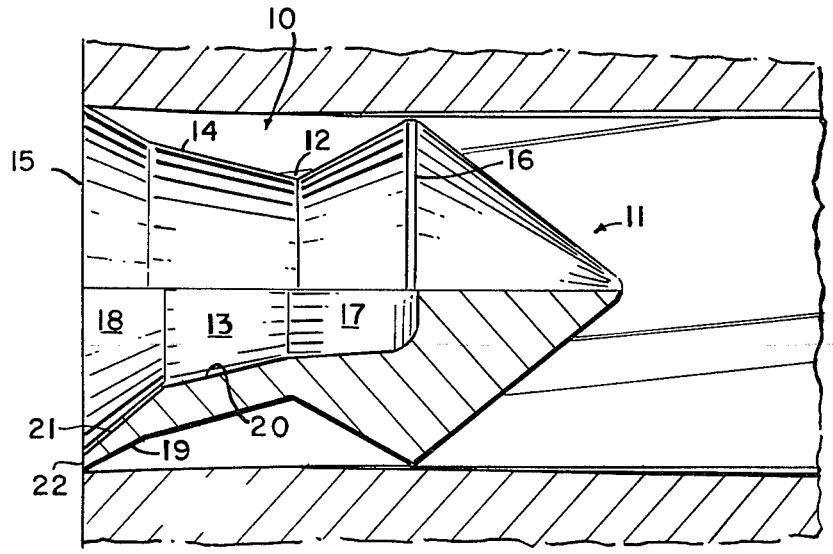
FIG. 1 is a side elevation view partly in diametral-axial cross section showing an improved pellet according to the invention in greatly enlarged scale.

Referring to the drawing, a pellet 10 generally indicated in FIG. 1 has a head portion 11, a waist portion 12, a hollow interior space 13, a conical skirt 14, and a free skirt margin 15 defining the rearward end of the projectile. The head 11 may be of any known form, and is herein illustrated as conical for a preferred embodiment having minimal coefficient of sliding friction and good near-sonic aerodynamic flight characteristics. In such pellet form the center of mass is relatively close, axially, to the intersection with the pellet axis of a plane passed through the maximum-diameter edge 16 formed by the junction of the waist portion 12 and the head portion 11. The axial length of the edge 16 is preferably small, and may be a fraction of one millimeter. The diameter of the head is preferably also so chosen as to be a free sliding fit along the barrel bore, for example the clearance on each side of edge 16 to the barrel should be of the order of at least a fraction of 1 mm in small bore guns such as 4.5mm and 5.6mm air arms a suitable head diameter for 4.5mm air arms being 4.2mm.

The hollow interior space 13 is conventional and comprisses a generally cylindrical bore 17 extending forwardly approximately to the plane of the edge 15, and communicates with the hollow interior 18 of the skirt which is of frustoconical form.

The skirt wall as in conventional profiles of projectile cross-sections of diabolo form has constant thickness over more than half its length, for example about 0.6mm in a pellet for a nominal 4.5mm bore, and the exterior surface of the skirt and of the waist may be conventionally ribbed to resist bulging under internal pressure.

The rearward part of the skirt wall comprises an axially-short portion 19 the exterior surface of which is of the form of a cone of greater included apical angle; more specifically, where the major portion of the skirt cone 14 is formed to an apical angle of about 23° to 29° the apical angle of the cone to which surface 19 conforms may be 60°. Expressed otherwise, the angle between the skirt 14 and the barrel or pellet axis will be about 11½°to 14½° of arc and the angle between the terminal skirt portion and the barrel surface will be about 30°.

The inner surface 20 of the skirt conforms to the conicity of the outer surface 14, while the conical inner surface 21 of the terminal skirt portion is bevelled to a still greater conical apical angle, for example about 75° although this angle may range upward to about 90°. The axial and the slope lengths of the inner bevelled surface 21 are made greater than the axial and slope lengths of the outer conic surface 19. For example, in a highly effective pellet form designed in accordance with the invention for nominal 4.5mm bore air rifles, the slope length 19 was 0.925mm, and the slope length 21 was 1.37mm. The end face 22 was shaped to lie in a right plane normal to the pellet axis, with a radial extent of about 0.3mm.

Figure 3:
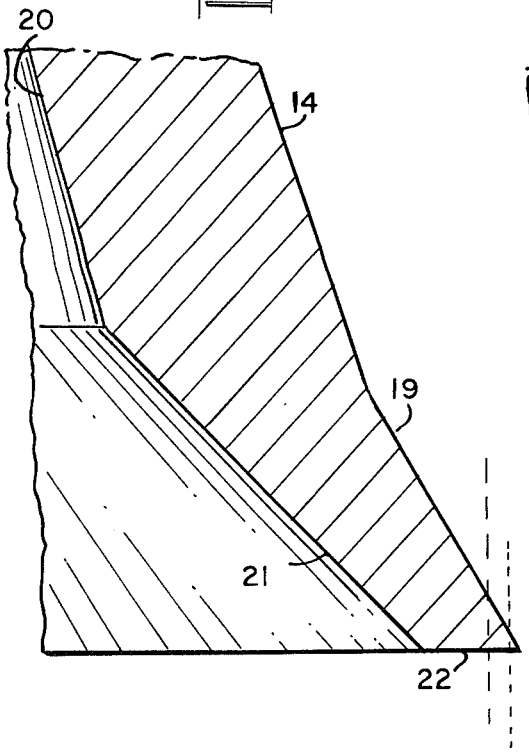
FIG. 3 is an enlarged detail of the skirt margin shown in FIG. 1, showing the dimensional relationship to barrel and rifling diameters.

In an air arm wherein the barrel is initially bored to the nominal diameter, for instance 4.5mm, the bore is thereafter spirally grooved to form bore lands alternating with rifling recesses having radial depths of from about 0.06mm to about 0.2mm or larger, the skirt margin of the improved pellet is shown in FIG. 3 as interfering by about 0.075mm, i.e. its peripheral diameter at edge 15 is larger than the nominal bore by about 0.15mm. Depending on the rifling groove depth, when the pellet is pressed forwardly certain sectional portions of the skirt adjacent the rifling grooves will either have a sliding clearance with the groove bottoms or they may also be an interference fit with the grooves. The axis length of the interference will be about 0.01mm. Such degree of interference is slight for a pellet molded from lead or lead alloy, and serves principally to prevent the inserted pellet at the time of loading from sliding along such part of the breech as may be slightly enlarged, for example having a root diameter of 4.57mm.

The dimensional relationships may be understood from FIG. 3 to provide that the initial engagement of skirt margin 15 with a tapered breech wall is such as to obtain effective initial gas sealing, and true coaxial insertion of the pellet where the taper is short so that the head of the pellet is slidably fitted in a barrel bore of nominal diameter.

Projectiles according to the invention exhibit good sealing when the pliant trailing edge annulus has a radial span which is less than one-half but greater than one-tenth of the thickness of the forward portion of the frustum shell wall.

Following the application of high pressure as air flows through the breech conduit into space 13, the

PROJECTILES FOR AIR ARMS

This is a continuation of application Ser. No. 560,399, filed Mar. 20, 1975, and now abandoned.

The present invention relates to gas-propelled projectiles such as pellets intended to be expelled at subsonic velocities from air pistols or air rifles, and particularly concerns a novel pellet configuration for achieving high uniform muzzle velocities and superior straightness of flight over usual target distances.

A projectile loaded into the barrel bore of a conventional air arm is propelled by the pressure of air which increases abruptly in the conduit leading to the breech as the piston is spring driven on release of the piston shaft. The energy stored in the spring is largely converted to work of compression performed as a nearly adiabatic process compressing the air ahead of the piston, but significantly large losses arise in the process of transferring kinetic energy of motion to the projectile from the compressed fluid. Ideally, the projectile should be a body whose configuration forms a perfect gas seal in the barrel and provides a predetermined large initial resistance to being dislodged from rest in its initial, loaded position, which resistance should abruptly fall to zero once the breach pressure has reached a high value nearly equalling the peak gas pressure achieved during the piston stroke. Stated otherwise, the body should move without friction once the gas temperature has peaked, and should accelerate to maximum muzzle velocity while the breech pressure remains near or at its highest value. In any practical barrel form the space behind the projectile is a storage vessel in which volume the entire compressed air charge is confined when the piston has been driven almost to the breech, at which time the projectile is about to be expelled. Consequently, the fraction of the work of compression represented by the column of highly compressed air in the bore is not available for further acceleration of the projectile as a secondary piston. Accordingly, it will be seen that any improvement in muzzle velocity is to be attained only by avoiding losses occurring while the projectile is in the barrel.

Hitherto a large number of projectile designs have been experimented with in attempting to increase the muzzle velocity. Current high-performance pellets are of "diabolo" form, i.e. they have a head portion of nominal bore diameter, a reduced-diameter waist, and a flaring skirt after-portion comprising a hollow frusto-conical shell wall merging at its lesser-diameter end with the head portion. Certain high-power air arms having precision rifled steel barrels are capable of accelarating the better projectile forms to muzzle velocities in the 680 – 780 feed per second range, excluding compression-ignition assist by ether or a hydrocarbon vapour released from the pellet.

The known forms of pellets are made of such materials and have their dimensions so chosen as to provide adequate frictional holding in the breech end of the barrel so that the inserted pellet will reliably remain stationary during barrel-closing and sighting, and so that a certain amount of drag resistance to movement is provided until the pressure has risen to several hundred pounds per square inch. Once this pressure is reached the forward movement of the pellet "grooves" the largest-diameter surface portions which engage the barrel lands and the rifling grooves, thereby imparting rotatory movement to the pellet so that it is expelled with a high spin velocity advantageous to trajectory stability. Lead and lead alloys are cast or molded in dies to produce such pellets, after which selection and cushioned packaging are performed to ensure that the pellets are without deformation.

In general, the best prior art pellets have a skirt margin which is relatively stiff and unyielding, so that insertion into the breech end of the barrel, even when the breech is tapered, requires firm pressure by the thumb to perform the initial swaging operation. While firm seating is achieved by such pellet forms, and a certain amount of initial build-up of gas pressure in the breech chamber is assured before the pellet breaks away from the static friction restraint, the pellet is not inherently self-aligning with the barrel axis, nor is the periphery of the skirt capable of being urged into such intimate engagement with the barrel bore and the rifling grooves as to avoid substantial "blow-by" of compressed air.

Certain air arms have a pellet-receiving breech and portion of the barrel wherein the bore has a diameter nearly equal to the diameter as measured between opposed rifling grooves, or even slightly larger than this diameter, so that the pellet skirt is insertable without appreciable swaging of the metal while the head portion is received in a nominal bore diameter barrel portion. While the pellet may be inserted in an initially coaxial relation to the barrel axis, as the pellet is driven forward the skirt is abruptly frictionally engaged by the reduced diameter barrel portion and remains briefly arrested until increasing air pressure drives it ahead, swaging the skirt periphery to form grooves. During this time the sealing action is imperfect and allows significantly large gas blow-by to occur, and further escape continues past the skirt margin throughout the pellet travel.

The present invention seeks to avoid the disadvantages of the known pellet configurations, and has as its principal objective the provision of a pellet form wherein the free marginal portion of the frusto-conical skirt has its inner rearward surface portion formed with a coaxial bevel so that the skirt margin tapers in thickness toward a thin rearward edge, and has a short axial length portion not longer than the internally bevelled portion which flares rearwardly outwardly with a greater apical angle, the maximum diameter of the skirt periphery being so dimensioned that it is a light interference fit in a barrel diameter equal to the diameter measured across opposed rifling grooves. The pellet is formed of a material such as lead or lead alloy preferably without hardening components and preferably a virgin metal which will swage readily in its reduced-thickness terminal edge region, enabling the skirt periphery to rapidly engage the barrel wall intimately upon rise of air pressure in the breech. When the pressure in the bore has reached its maximum value, which in well designed air arms occurs when the projectile has moved only a few inches, the pellet is a freely-sliding but closely-fitted secondary piston, the skirt margin being molded to an axially-short annular ring portion of substantially constant axial length, the outer surface of which is engaged in close conformity to the transverse cross-sectional internal surface of the barrel, i.e. sliding along both the barrel lands and the bottoms of the rifling grooves. The remainder of the terminal frusto-conical portion is out of contact with the barrel. The relatively pliant terminal edge portion assures that the pellet axis coincides substantially with the barrel axis.

Figure 6:
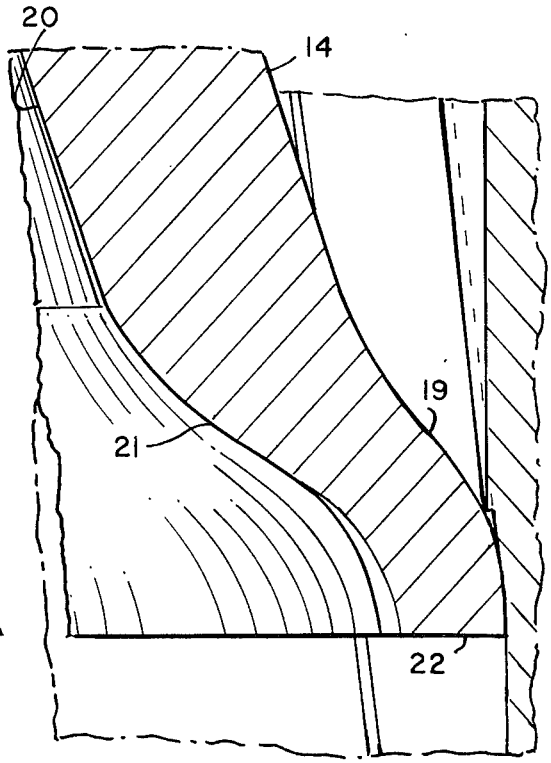
Figure 2:
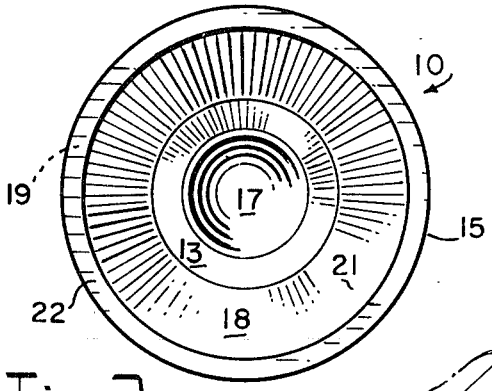
FIG. 2 is an axial projection of the pellet of FIG. 1 viewed from the rear.
Figure 4:
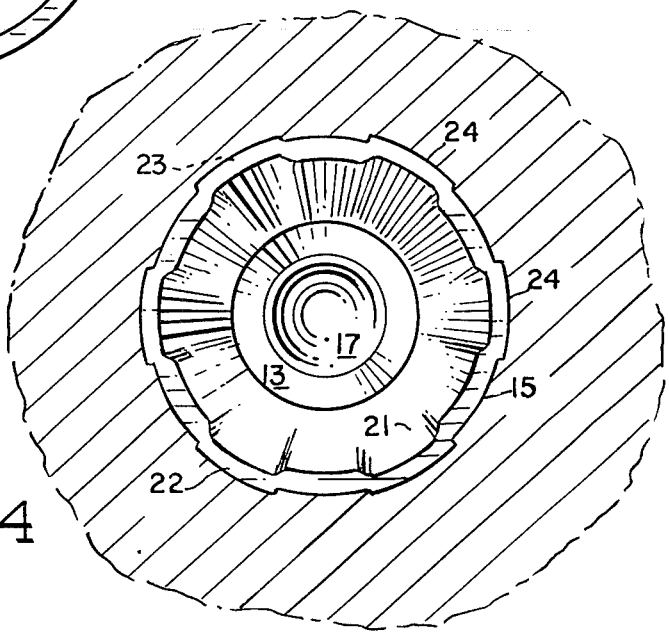
FIG. 4 is a view of the pellet of FIG. 2 showing the skirt periphery as molded to the barrel wall by maximum breech gas pressure.

The pellet form according to the present invention may have any conventional head profile, and for high-relatively pliant portion of the skirt wall lying outwardly of inner surface 21 is rapidly deformed plastically, bulging uniformly radially about the periphery of the skirt margin to bring a ring-shaped band 23 of metal into close sliding engagement with the barrel. Such ring-shaped volume is axially short, e.g. having an outer length of about 0.350mm axial dimension and an inner axial length about 0.180mm. It is this ring-shaped metal volume in which complementary ridges 24 of short axial length are molded by the rifling grooves as the pellet is driven a short distance along the bore, and in which sectoral portions are swaged radially inwardly between the ridges 24 to fit the nominal bore diameter, as may be seen from FIGS. 4 and 6. The main body of the skirt however remains undeformed, as will be seen by comparing FIGS. 3 and 6, so that the bevelled surfaces 19 and 21 undergo the only significant radial enlargement. An intimate gas sealing conformity results between the exterior bevel surface 19 and the barrel wall and the rifling grooves. Consequently the pressure developed in the breech conduit by the action of the driving piston on the air confined between the projectile and the piston attains the maximum possible value and hence provides a greater driving force for accelerating the projectile.

Whereas the initial static friction force retaining the projectile in its loaded position is relatively small, and the drag force between the deformed ring surface and the barrel wall is smaller than that pertaining to pellets with relatively unyielding skirt marginal portions, the initial burst of pressure exerted on the pliant edge portion is believed to exert a substantial degree of restraint to pellet movement, until it has advanced a few diameters and the swaging action is substantially terminated; by that time the bore pressure will have peaked and the coefficient of moving friction will have come into effect, diminished by take-up of any lubricant film available in the barrel. An exact analysis of the friction forces is impossible and the behaviour can only be conjectured; nevertheless the observed velocity improvement and the superior trajectory of pellets strongly support the hypothesis that the pliant skirt margin form achieves adequate initial restraint, accurate coaxiality of propulsion, and highly effective gas sealing, with relatively low friction drag during the higher-velocity travel of the pellet along the barrel.

Figure 5:
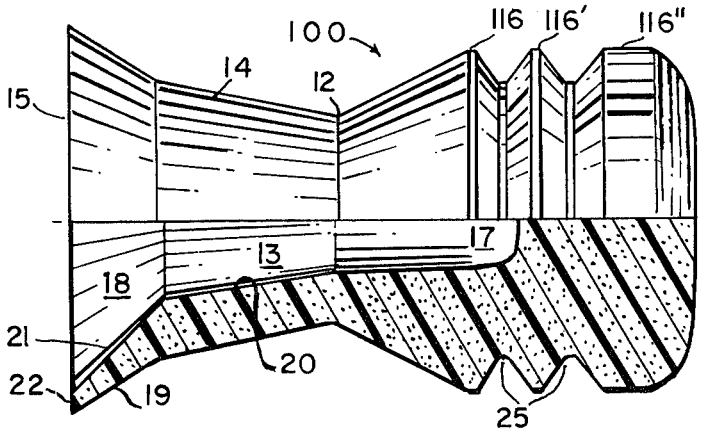
FIG. 5 is a side elevation view similar to FIG. 1 showing a longer pellet molded of a metal/plastic composition; and, FIG. 6 is a companion diagram to FIG. 3 showing the skirt margin of the pellet deformed by the maximum breech gas pressure.

While the foregoing description has dealt with pellets formed of a metal, which conventionally is lead or a lead alloy to facilitate molding and to gain the advantage of greater mass for a given volume, the practice of the invention may be usefully extended to the forming of projectiles from other materials, particularly from compositions in which a resinous matrix is loaded by dense particulate material. While the density of the molded pellet will be lower the projectile weight can in part by made up by head elongation and reduced internal space, as in the pellet form shown in FIG. 5. The composition pellet 100 comprises the main skirt portion 14 and terminal flared portion 19 as has previously been discussed, with a reduced bore diameter 17. The head 111 is elongated and provided with spaced narrow lands 116, 116' and 116'' separated by annular grooves 25. In this embodiment, the apical angle of the cone to which surface 14 generally conforms may be about 23°, the apical angle to which flaring skirt portion 19 generally conforms may be about 66°, and the apical angle of the cone to which inner surface 21 generally conforms may be about 90°.

The composition may comprise any dense particulate filler including pulverulent lead and lead alloys, particulate lead sulfide (galena), Bismuth, Tantalum, Nickel and Copper, or alloys thereof, and even magnetite. As resinous binders a large range of thermoplastic and/or thermosetting resins may be incorporated, preferably in a minor weight percentage. Polyethylene and polypropylene will generally be chosen for lowest cost; however for lowest friction drag the preferred resin binder would be polytetrafluoroethylene, although incorporation of fillers therewith requires small particle dimensions of both constituents. The molding of such compositions is carried out conventionally in sectional molding dies.

It is to be understood that the invention extends to pellet forms for use with air arms of any calibre, in which the compressed air or gas driving system accelerates the projectile to a velocity in the subsonic range. The primary utility of the projectiles is in the competitive sport field where highly uniform muzzle velocity is an advantage.

I claim:

1. In a projectile for an air arm molded as a body of revolution about a longitudinal axis comprising a head portion dimensioned for free sliding fit in the bore of the air arm and a skirt-like after portion of frusto-conical form of which the rearward end is dimensioned to be an interference fit in the said bore and the forward end is joined with the head portion in a reduced diameter waist, the frustum being shell-walled and having a central recess opening to the rear and extending forwardly into said head portion, the improvement wherein a major forward length portion of said frustum has an outer surface conformed to a cone of apical angle about 60° and wherein a minor rearward terminal length portion of the frustum flares outwardly from the forward length portion and has an outer surface conforming to a cone of apical angle ranging from about 70° to about 75°, the rearward terminal portion of said shell-walled portion tapering in thickness to form a pliant trailing edge of annulus form.

2. A projectile as set forth in claim 1 wherein said pliant trailing edge includes a conic inner surface conforming to a cone of about 80° apical angle and the radial span of the annulus is less that half but greater than one-tenth of the thickness of the forward portion of the frustum shell wall.

3. A projectile as set forth in claim 1 wherein the trailing edge annulus has an outer radius slightly greater than the rifling groove radius of the air arm and has a radial span such that the nominal bore radius distance falls within the outer half of the span.

4. A projectile as set forth in claim 2 wherein the slope length of the inner conic surface of the trailing edge portion of the frustum is about 1.3mm, and the trailing edge annulus has a radial span of about 0.3mm.

5. In a projectile for an air arm wherein the projectile form is a body of revolution about a longitudinal axis comprising a head portion dimensioned for free sliding fit in the bore of the air arm and an after portion of frusto-conical form having its rearward end dimensioned to be an interference fit in the said bore and having its forward end of reduced diameter joined with the head portion, the frustum being shell-walled and having a coaxial recess enlarging toward said rearward end and extending axially forwardly into said head portion, the improvement wherein: a major forward axial length portion of said after portion is conformed generally to a cone of a first predetermined apical angle, and wherein the outer surface of a minor rearward terminal axial length portion of said after portion flares outwardly rearwardly from a junction with the said major forward length portion and said outer surface conforms generally to a cone of a second predetermined acute apical angle which is larger than said first predetermined acute apical angle, and the shell wall thickness of said minor rearward terminal axial length portion reduces rearwardly so that the projectile has a pliant annular trailing edge.

6. A projectile as set forth in claim 5 wherein said body of revolution is molded from lead or a lead alloy.

7. A projectile as set forth in claim 5 wherein said body of revolution is molded from a composition consisting of a major weight proportion of a dense material of particulate form loading a matrix of a minor weight proportion of a resinous binder.

8. A projectile as set forth in claim 5 having a conic head portion of which the maximum diameter portion comprises an axially short cylinder adjoining the base of the head cone.

9. A projectile as set forth in claim 5 wherein the head portion is cylindriform and terminated by a forward blunt end face and the cylindrical surface is peripherally grooved, the grooves separating axially narrow bands.

10. A projectile as set forth in claim 5 wherein the projectile head diameter is about 4.2mm, the trailing edge diameter is about 4.65mm, and the trailing edge annulus has a radial span of about 0.3mm. for an air arm of normal bore diameter 4.5mm.

* * * * *